United States Patent [19]

Ross

[11] Patent Number: 4,698,532

[45] Date of Patent: Oct. 6, 1987

[54] ELECTROMAGNETIC PROJECTILE LAUNCHER WITH EXPLOSIVE-START AND PLASMA DRIVE

[75] Inventor: David P. Ross, Center Township, Beaver County, Pa.

[73] Assignee: Westinghouse Electric Corp., Pittsburgh, Pa.

[21] Appl. No.: 659,029

[22] Filed: Oct. 9, 1984

Related U.S. Application Data

[63] Continuation of Ser. No. 399,509, Jul. 19, 1982, abandoned.

[51] Int. Cl.[4] ..... H02K 41/00

[52] U.S. Cl. ..... 310/12; 310/11; 318/135; 89/8

[58] Field of Search ..... 310/10–13, 310/14; 102/202.7; 89/8; 318/135; 124/3

[56] References Cited

U.S. PATENT DOCUMENTS

| | | | |
|---|---|---|---|
| 3,337,760 | 8/1967 | Allport | 310/13 |
| 3,878,409 | 4/1975 | Gill et al. | 310/11 |
| 4,121,123 | 10/1978 | Crolius | 310/11 |
| 4,220,088 | 9/1980 | Kimura et al. | 102/202.7 |
| 4,319,168 | 3/1982 | Kemeny | 318/135 |
| 4,334,474 | 6/1982 | Coltharp | 102/202.7 |
| 4,347,463 | 8/1982 | Kemeny et al. | 318/135 |
| 4,354,432 | 10/1982 | Cannavo' et al. | 102/202.7 |
| 4,431,816 | 3/1969 | Dale | 89/8 |

*Primary Examiner*—Donovan F. Duggan
*Attorney, Agent, or Firm*—R. P. Lenart

[57] ABSTRACT

An electromagnetic projectile launcher is provided with an insulating cartridge having an internal pressure chamber and an aperture for receiving a projectile assembly. A fuse element within the pressure chamber is electrically connected to a pair of generally parallel conductive launcher rails. Current flow through the fuse element causes it to explode and create a high pressure plasma within the pressure chamber. This high pressure plasma forces the projectile assembly to accelerate away from the cartridge and later serves as a means for conducting current between the conductive rails and for propelling the projectile assembly along the rails.

5 Claims, 3 Drawing Figures

ELECTROMAGNETIC PROJECTILE LAUNCHER WITH EXPLOSIVE-START AND PLASMA DRIVE

This application is a continuation of application Ser. No. 399,509, filed July 19, 1982, now abandoned.

BACKGROUND OF THE INVENTION

This invention relates to electromagnetic projectile launching systems and more particularly to such systems which utilize an exploding fuse in an air tight cartridge to generate a plasma with sufficient pressure to impart starting momentum to a projectile.

Electromagnetic projectile launchers are known which comprise a pair of conductive rails, a sliding conductive armature between the rails, a source of high current and a switch for commutating this current into the rails and through the armature. Current flow through the rails and armature results in an electromagnetic force on the armature which propels it along the conductive rails. Launchers which utilize a sliding metallic armature have experienced considerable rail damage caused by the sliding armature, particularly where high armature velocities are involved. In these cases, a plasma (arc) armature may be more suitable.

The principal disadvantage to the use of a plasma propelling armature has been the damage that occurs to the breech section of the launcher rails during formation of the plasma. Once the plasma is moving, very little, if any, damage occurs to the rails. Copending commonly assigned application entitled Electromagnetic Launcher With Self Augmented Rails, Ser. No. 137,059, filed Apr. 3, 1980 by Kemeny and Litz, now U.S. Pat. No. 4,347,463, issued Aug. 31, 1982 discloses a means for establishing an arc for propelling a projectile comprising a shooting wire or fuse which initiates current flow between the rails, disintegrates, and thereby forms an ionized plasma or arc through which current continues to flow. Because the mass ratio between a projectile and a plasma armature is greater than that between a projectile and a sliding metallic armature, more efficient utilization of available launch package energy is possible with plasma drive. In addition, plasma drive provides a means for launching ultra high velocity projectiles with good shot-to-shot reproducibility. Therefore, the application of plasma driven projectiles in multi-shot systems is appropriate. Such systems include rapid fire air defense systems and impact fusion reactors.

Several methods have been suggested for initiating an arc or plasma in electromagnetic launcher systems. These procedures are primarily directed toward resolving the problem of creating the plasma armature and minimizing the resulting thermal damage of the launcher rails. Ablation of the rail surfaces is caused by a slow moving or stationary arc and occurs during initial acceleration of the projectile from zero velocity. At higher projectile velocities, the effects of this thermal phenomenon become increasingly insignificant. Therefore a means for imparting initial momentum to the launch package is desired to prolong launcher rail life.

Excessive launcher rail damage has been observed where a copper fuse is blown to form a plasma composed mainly of copper ions. This resulted in sputtered metal from a partially vaporized fuse and thermal erosion of the rail surfaces from a slow moving or stationary arc over only a short length of rail starting at the original location of the fuse in the breech. The present invention seeks to minimize launcher rail damage caused by slow moving plasmas in the breech area by utilizing an exploding fuse in an air tight insulating cartridge to generate a plasma with sufficient pressure to impart starting momentum to the projectile before electromagnetic forces dominate to propel the projectile along the launcher rails.

SUMMARY OF THE INVENTION

An electromagnetic projectile launcher constructed in accordance with the present invention comprises: a pair of generally parallel conductive rails; a source of high current; an insulating cartridge located between the rails in the breech area, having a pressure chamber and an aperture for receiving a projectile; a fuse element within the pressure chamber; and means for electrically connecting the fuse element to the rails. A projectile forms an air tight seal with the aperture of the cartridge to close the pressure chamber. During a launch, a high current flows through the fuse element causing it to explode and form a high pressure plasma within the cartridge pressure chamber. This plasma forces the projectile away from the cartridge thereby imparting a starting momentum to the projectile. The plasma flows out of the cartridge and serves as means for conducting current between the rails and for propelling a projectile along the rails. The insulating cartridge serves as an initial buffer between the rail surfaces and the original arc discharge and rail damage caused by the propelling plasma is minimized by providing the projectile with an initial velocity.

DESCRIPTION OF THE PREFERRED EMBODIMENT

Figure 1:
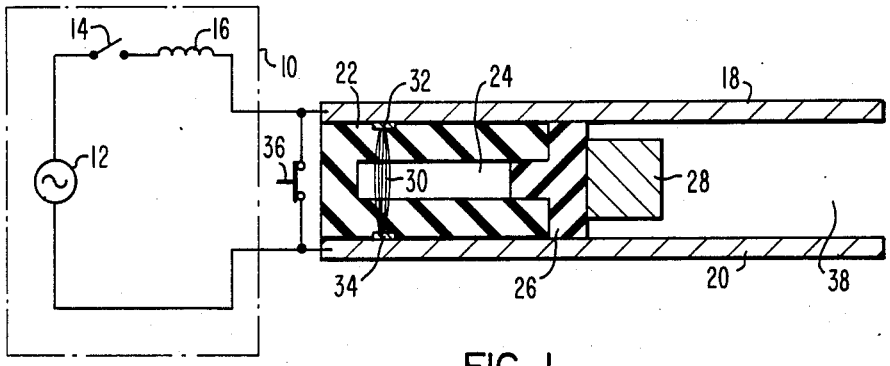
FIG. 1 is a schematic drawing of an electromagnetic projectile launcher in accordance with one embodiment of the present invention.

Referring to the drawings, FIG. 1 is a schematic representation of an electromagnetic projectile launcher in accordance with one embodiment of the present invention. A high current source 10 comprising the series connection of DC generator 12, switch 14 and inductor 16 is connected to a pair of generally parallel conductive rails 18 and 20. An insulating cartridge 22 is inserted into the breech area of conductive rails 18 and 20 and includes a pressure chamber 24 having an aperture for receiving a projectile assembly comprising an insulating bore sealing sabot 26 and a projectile 28. A fuse element 30 is located within pressure chamber 24 and electrically connected to rails 18 and 20 by contacts 32 and 34 respectively. For the inductive source of high current shown in this embodiment, switch 36 provides a means for commutating current from high current source 10 to rails 18 and 20. For other types of high current sources, switch 36 may be eliminated with fuse element 30 serving as the initial means for conducting current between rails 18 and 20 as cartridge 22 is inserted into the bore.

When a projectile is to be launched by the launcher of FIG. 1, switches 14 and 36 are initially closed so that a high current can be developed by generator 12, which may be a homopolar generator, through inductor 16. When the desired launch current is achieved, switch 36 is opened thereby commutating current into rails 18 and 20. Fuse contacts 32 and 34 serve as means for electrically connecting fuse element 30 to rails 18 and 20. Current flow through fuse element 30 causes it to explode thereby creating a high pressure plasma within pressure chamber 24. The projectile assembly forms an interference fit in the aperture of pressure chamber 24 which controls the amount of pressure required to cause separation of the projectile assembly from cartridge 22. Once sufficient pressure has been achieved, the projectile assembly is accelerated by this pressure along rails 18 and 20 and the highly ionized high pressure plasma enters the space between the cartridge and the projectile assembly to serve as means for conducting current between rails 18 and 20 and for propelling the projectile assembly along bore 38. Insulating sabot 26 seals bore 38 to prevent the leakage of the plasma around projectile 28.

Figure 2:
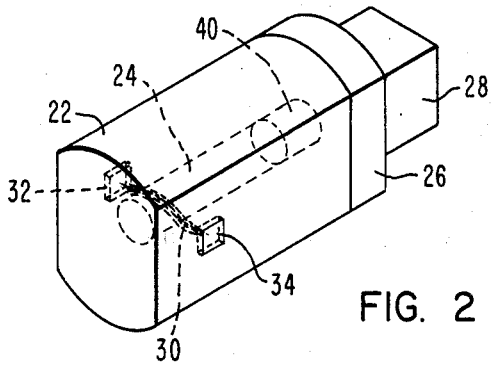
FIG. 2 is a isometric view of the cartridge/projectile assembly of the launcher of FIG. 1.

FIG. 2 is an isometric view of the cartridge/projectile assembly of the launcher of FIG. 1. Fuse element 30 may vary in geometry depending on the type of material to be vaporized and on the desired characteristics of the resulting plasma. For example, the fuse element can be constructed of shredded metal fibers rolled into a ball or of single strands of wire. Fuse contacts 32 and 34 are located on the outer surface of cartridge 22 and provide a means for electrically connecting the fuse element 30 to launcher rails 18 and 20. The projectile assembly is force fitted into the aperture of pressure chamber 24 resulting in an air tight seal. An interference fit along surface 40 is used to regulate the bursting pressure necessary to separate the projectile assembly from cartridge 22. The bursting pressure of cartridge 22 may exceed the working pressure of the cartridge many times since the launcher barrel actually withstands the additional pressure load.

In practice, cartridge 22 may be clamped firmly between the launcher rails in the breech. The clamping action exerts the required pressure between the fuse contact surfaces and the rails and locks the cartridge in place. Once the projectile assembly has been launched, the old cartridge is then removed and a fresh cartridge/projectile assembly inserted.

Figure 3:
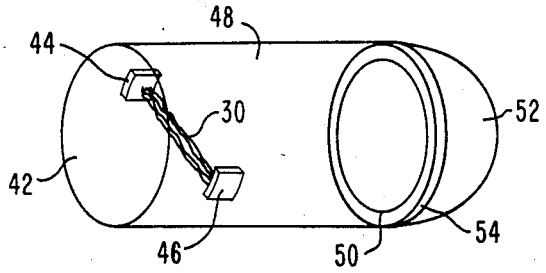
FIG. 3 is an alternative cartridge/projectile assembly in accordance with the present invention.

FIG. 3 is an alternative cartridge/projectile assembly for use in a launcher having a circular bore. Insulating cartridge 42 is cylindrically shaped in this embodiment while fuse contact elements 44 and 46 are arcuately shaped to conform to the inner surface of the launcher rails. As with the previous embodiment, the explosion of fuse element 30 creates pressure within pressure chamber 48 and projectile assembly 42 forms an interference fit with aperture 50 at the end of cartridge 42. An insulating sabot 54 is provided to seal the bore after the plasma generated by the explosion of fuse element 30 begins to conduct current between the launcher rails and serve as means for propelling projectile 50 along the bore.

While there has been described what at present is considered to be the preferred embodiment of the invention, it will be apparent to those skilled in the art that various changes may be made therein without departing from the invention. For example, the projectile can be shaped to perform the bore sealing function, thereby eliminating the sabot structure. It is therefore intended that the appended claims cover all such changes that fall within the scope of the invention.

What is claimed is:

1. An electromagnetic projectile launcher comprising:

a pair of generally conductive rails;

a source of current connected to said rails;

an insulating cartridge disposed between said rails, said cartridge having a pressure chamber, and an aperture for receiving a projectile wherein said aperture is sized to provide for an interference fit between said cartridge and said projectile;

a fuse element within said pressure chamber;

means for electrically connecting said fuse element between said rails;

means for commutating current at a preselected magnitude from said current source to said rails such that the commutated current initially passes through said fuse element causing it to explode, thereby creating a plasma within said pressure chamber, said plasma having sufficient pressure to produce initial movement of said projectile between said rails, and said plasma subsequently serving as a means for conducting said preselected magnitude of commutated current between the rails and for propelling the projectile along the rails; and a portion of each of said rails, extending from said projectile to said means for electrically connecting said fuse, being lined by said insulating cartridge thereby preventing contact between said portion and said plasma. --.

2. An electromagnetic projectile launcher as recited in claim 1, wherein said means for electrically connecting said fuse element comprises:

a pair of fuse contacts, each extending from said pressure chamber to an exterior surface of said cartridge, one end of each of said contacts being shaped to conform to the inner surface of an adjacent one of said rails. --

3. An electromagnetic projectile launcher as recited in claim 1, wherein said insulating cartridge is constructed of an arc resistant material.

4. An electromagnetic projectile launcher as recited in claim 1, wherein said fuse element comprises:

a plurality of metal fibers.

5. An electromagnetic projectile launcher as recited in claim 1, wherein said fuse element comprises:

a strand of copper wire.

* * * * *